United States Patent [19]

Fredenucci et al.

[11] Patent Number: 4,612,251

[45] Date of Patent: Sep. 16, 1986

[54] PAPER SHEET HAVING A VERY HIGH PROPORTION OF LATEX, PROCESS FOR PREPARING SAME AND APPLICATIONS THEREOF PARTICULARLY AS A SUBSTITUTION PRODUCT FOR IMPREGNATED GLASS WEBS

[75] Inventors: Pierre Fredenucci; Jean-Bènard Berhaut, both of Charavines, France

[73] Assignee: Arjomari-Prioux, Paris, France

[21] Appl. No.: 513,432

[22] Filed: Jul. 13, 1983

[30] Foreign Application Priority Data

Jul. 30, 1982 [FR] France ..... 82 13391
Nov. 5, 1982 [FR] France ..... 82 18624

[51] Int. Cl.[4] ..... B32B 23/08

[52] U.S. Cl. ..... 428/511; 162/158; 162/181.1

[58] Field of Search ..... 162/158, 181.1; 428/511

[56] References Cited

U.S. PATENT DOCUMENTS 4,011,130 3/1977 Worden ..... 162/181.1
4,487,657 12/1984 Gomez ..... 162/158

FOREIGN PATENT DOCUMENTS 1588354 4/1981 United Kingdom .

*Primary Examiner*—James J. Bell
*Attorney, Agent, or Firm*—Bacon & Thomas

[57] ABSTRACT

100 parts by dry weight of latex, approximately, are used for about 45 to 140 parts by dry weight of fibrous mixture.

Manufacture particularly by double flocculation (addition of each flocculating agent partly before and partly after the addition of latex).

Very good properties, particularly breakage strength and delamination resistance.

15 Claims, No Drawings

PAPER SHEET HAVING A VERY HIGH PROPORTION OF LATEX, PROCESS FOR PREPARING SAME AND APPLICATIONS THEREOF PARTICULARLY AS A SUBSTITUTION PRODUCT FOR IMPREGNATED GLASS WEBS

Paper sheet having a very high proportion of latex, process for preparing same and applications thereof particularly as a substitution product for impregnated glass webs.

The present invention relates to the field of substitution products for impregnated glass webs.

More precisely, the inventon relates to sheet products obtained by paper-making techniques, with a very high content of latex precipitated in the mass.

It has been discovered that, surprisingly, it was possible to increase to a considerable extent the proportion of precipitable latex, whilst preserving the possibility of obtaining, directly by a single passage over a paper-making machine, thermoplastic sheets having excellent mechanical properties.

For the manufacture of these sheets, the "double flocculation" technique will be particularly used; this has been described notably in French Patent Application No. 78-18447 filed June 20, 1978 which corresponds to U.S. Pat. No. 4,487,657, to which the technician skilled in the art could easily refer for the details of its employment.

It is remarkable and surprising to observe that the products whose composition will be described below, containing an unusual total latex proportion, which can reach, for example, ⅔ by weight of the product, have been producable on a paper-making machine, which hitherto was not considered possible.

The novel products obtained are characterisedby a very high level of breakage strength, both cold and hot.

Moreover, it is very difficult, after double-faced coating, for example with plastisol (PVC powder+plasticiser) followed by a heat treatment of about 160°-200° C., to delaminate the composite product obtained.

The product obtained has moreover a good aptitude to pliability.

Consequently, the products according to the invention may be used as substitution products for impregnated glass webs particularly in uses like floor and wall coatings.

It must also be noted that the choice of the latex is determining in the practising of the invention, certain latices enabling a set of good properties to be obtained: breakage resistance when cold and when hot, resistance to delamination and good power of adhesion with respect to PVC, dimensional stability, pliability properties, particularly.

The tests carried out on a large number of latices have shown that vinyl copolymers were the most suitable (cf. tests no. 11 221 and 11 222 in Table I below).

Suitable results have also been obtained with styrene-butadiene copolymers and polymers or copolymeres containing acrylic units.

According to the invention, about 45 to 140 parts by dry weight of fibrous mixture are used for 100 parts by dry weight of latex.

The fibrous mixture used according to the invention is itself constituted by 30 to 90 parts by dry weight of cellulose fibres and about 15 to 50 parts by dry weight of non-cellulose fibres.

The non-cellulose fibres will preferably be glass fibres or indeed other mineral or synthetic fibres such as rock wool, polyester fibres and similar fibres.

It is surprising to note that a support obtained by paper-making from such a basic composition has the good properties indicated above, particularly as regards breakage strength and resistance to delamination.

Good results have been obtained by introducing the above-mentioned flocculants in the following order:

fibrous mixture
1st addition of flocculant
latex
2nd addition of flocculant
3rd addition of flocculant.

In the tests slightly refined cellulose fibres, particularly at 25° SR, and glass fibres of length about 3 or 4 mm and diameter 10 to 11μ are used.

It will however be possible to use glass fibres of length comprised between 3 and 12 mm, preferably 3 and 6 mm, and of diameter comprised between 5 and 15μ.

The choice of a type of glass fibre conditions the choice of the content of these fibres in the mixture, in manner known to the technician skilled in the art.

As floculants it well be possible particularly to use products of which the list is given in the aforesaid patent application and the corresponding European Patent Application No. 00006 390 (cf. Table II below) which corresponds to U.S. Pat. No. 4,487,657).

It will also be possible to use conventionally, adjuvants known in the paper making field, anti-foaming agents, coloring agents, sizing, dry strength, moisture resistance and imp utrescibility agents etc.

The compositions used as well as the results of the tests are assembled in Table I below. These are non limiting examples.

In particular, the nature of the floculants their dose (as well as the number and place of the points of introduction) may vary as a function of the nature of the latex used, of the equipement, and of the contact time between the product; the total dose of floculants will normally be comprised between 5 and 50 parts by dry weight for 100 parts of latex.

Table I and the operational method below provides particular information which will enable the man skilled in the art to adapt the technique according to the invention to a variation of these parameters.

The operational method corresponding to the tests presented in table I is as follows:

| | |
|---|---|
| fibrous mixture: | |
| cellulosic resinous fibres, soda treated, bleached 25° SR | 50 parts by weight (dry) |
| glass fibres (4 mm, 11μ; "VITROFIL" CSW) | 10 parts by weight (dry) |
| floculant (polyamine/polyamide-epichlorhydrin) Nadavin LT [contact time of approximately 5 min.] | 4 parts by weight (dry) |
| latex (cf. Table I) [contact time of approximately 5 min.] | 100 parts by weight (dry) |
| floculant added after latex (high molecular weight polyacrylamide) in two stages: | |
| (1) to the Vat (cf. Table I) | $x_1$ parts by weight (dry) |
| (2) at the top | $x_2$ Parts by weight (dry) |

$x_1$ is the amount necessary for total precipitation. The mixture is then sufficiently stable to be led to the top part of the machine where the last addition of floculant is carried out.

The compositions described above as regards Table I show again two properties which it has been adjudged desirable to improve, particularly for the applications where the coating of Plastisol is effected on a single face, which renders more problematic the production of the flat aspect of the final product.

Thus the dimensional stability in water (test accelerated after 8 min of immersion on the FENCHEL apparatus) of such a product previously stoved 2 min at 200° C. is of the order of 0.20% (extension in the transverse direction), and this product, after coating with Plastisol on one surface, has a degree of roll or "curl" higher than 20% (shrinkage in transverse direction). For the description of the test, refer to French Patent Application No. 82 12 319.

According to the invention the preferred composition of the invention described below, has a dimensional stability to water less than 0.10% is arrived at and a proportion of shrinkage on curling less than 5%, which represent remarkable improvements.

The man skilled in the art will understand the great difficulty resides in the fact that the desired improvement of these properties should not reduce the other properties of the product obtained.

It is known in fact, for example, that, if the proportion of glass fibres is increased, the mechanical properties are rapidly reduced (particularly as regards the delamination strength, as essentiel property taking into account the envisaged application as floor and wall coverings).

It is also known, that in such a case, one runs up against the appearance of a phenomenon called "fluffing" (extraction of the glass fibres, if they are in too high a proportion).

It is hence surprising to observe that the invention has arrived at conciliating requirements whose contradictory character—and hence a priori irreconciliable—were known.

The preferred composition used according to the invention as well as the products of the tests are assembled in Table III below, as non-limiting examples (Examples 1 to 5).

In particular, the nature of the floculants, their dose, as well as the number and place of introduction, can vary according to the nature of the latex used, the equipment, the contact time between the products; the total dose of floculants, which depends itself on the nature of these floculants ((in particular the molecular weight, the ionicity, etc of the floculant), will be comprised between 2 and 30 parts by weight, preferably 3 and 10, per 100 parts by weight of latex.

According to the invention, after the "stage 1" which is described above, it is interesting to carry out an additional treatment of "stage 2" with the purpose of further improvement of:

the state of the surface (suppression of fluff-formation or extraction of glass fibres);

the properties of barrier" to water, to plasticisers;

non-putrescibility;

mechanical strength;

rigidity and flexibility, hence the characteristics of curling and pliability.

To overcome the curling of the product coated with Plastisol on the front surface, it is possible to carryout preferably a treatment of stage 2 on the back surface.

These stage 2 treatments may be operations of layering, impregnation or surfacing aimed at depositing at the surface or within, chemical components by (spraying, size press, layer formation with blades or rolls, etc). In particular the addition of latex or a plasticiser by a size press will be mentioned.

It will also be possible to carry out heat and/or mechanical treatments, such as smoothing or calandering cold or hot.

The technician skilled in the art understands these techniques and will know how to select the products to be used according to the desired characteristics.

The product will be deposited generally in the proportion of 10 to 100 g/m$^2$ (wet state), namely 2 to 60 g/m$^2$ after drying (preferably 2 to 20 g/m$^2$) in the case of treatment on a single surface, and 3 to 40 g/m$^2$ in the case of treatment on both surfaces.

In Table IV below will be found a comparison between the known impregnated glass webs and the products according to the invention (Examples 1 to 5). The technician skilled in the art will observe that the products according to the invention are both much lighter, much less dense and much more solid.

There will also be found below three examples of compositions according to the invention having a particular interest

EXAMPLE 6 (MP 17759)

cellulose fibres: 45 parts by dry weight
glass fibres (4 mm): 20 parts by dry weight
latex: 100 parts by dry weight (latex (d) in Table III).

EXAMPLE 7 (MP 17765)

Product with stronger internal cohesion.
cellulose fibres: 31.5 parts by dry weight
glass fibres: 15 parts by dry weight (4 mm)
latex: 100 parts by dry weight (latex (d) in Table III)

EXAMPLE 8 (MP 17835)

Product with a stronger internal cohesion.
cellulose fibres: 31.5 parts by dry weight
glass fibres: 25 parts by dry weight (3 mm)
latex: 100 parts by dry weight (latex (d) in Table III)

The compositions, processes and results corresponding to Examples 6, 7 and 8 are grouped in Tables V and VI below.

TABLE I

| | TEST | | | |
|---|---|---|---|---|
| latex (chemical nature) | F 11211 copolymer vinyl chloride/ethylene/vinyl acetate (1) | F 11222 copolymer vinyl chloride/acrylate (2) | F 11224 copolymer styrene/butadiene (3) | F 11225 copolymer acrylic (4) |
| Doses of floculants (parts of dry weight) | | | | |

TABLE I-continued

| | | | | |
|---|---|---|---|---|
| $x_1$ | 1 | 1 | 0.5 | 0.03 |
| $x_2$ | 0.6 | 0.8 | 0.6 | 0.4 |
| RAW PAPER | | | | |
| weight per unit surface g/m$^2$ | 204 | 218 | 204 | 215 |
| thickness $\mu$ | 255 | 251 | 297 | 285 |
| handle | 1.25 | 1.15 | 1.46 | 1.32 |
| tensile strength (kgf for 15 mm) | | | | |
| SM cold 23° C. | 15 | 12 | 11 | 8 |
| SM hot 2 min. 200° C. | 2.1 | 1.5 | 2.6 | 2.8 |
| STOVED PAPERS 2 min at 200° C. (before coating) Dimensional stability in water ST (8 min) (%) | 0.15 | 0.10 | 0.20 | 0.25 |
| PAPERS AFTER DOUBLE SIDE PVC COATING AND GELIFICATION at 200° C. | | | (xx) | |
| Resistance to delamination (g/cm) | $\geq$ 600 | $\geq$ 600 | peeling | $\geq$ 450 |
| Pliability | good | good | good | good |

SM machine direction
ST transverse direction
(xx) no measurement since the plastic sheet detaches.
To overcome this drawback, a surfacing must be carried out facilitating the adhesion of the PVC.
Notes:
(1) Terpolymer vinyl acetate: 54–60% by weight
ethylene 10–16% by weight
vinyl chloride 27–33% by weight
(2) 70 to 90% of vinyl chloride units
10 to 30% of methyl acrylate units
Copolymer plasticised with 30 to 40% of dioctylphthalate
(3) 60% of styrene units
40% of butadiene units
(4) Acrylic copolymer:
ethyl acrylate 87–97%
acrylonitrile 1–8%
N—methylolacrylate 1–6%
acrylic acid 1–6%

TABLE II

FLOCCULATING OR PRECIPITATING AGENTS

| Reference | Type of flocculating or precipitating agent |
|---|---|
| P 1 | Aluminium sulfate |
| P 2 | Aluminium polychloride |
| P 3 | Aluminate of sodium and of calcium |
| P 4 | Mixture of polyacrylic acid and of polyacrylamide in 5–30% (weight/volume) solution |
| P 5 | Polyethyleneimine in 2–50% (weight/volume) solution |
| P 6 | Copolymer of acrylamide and of $\beta$-methacrylyloxyethyltrimethyl ammonium methylsulfate |
| P 7 | Polyamine-epichlorohydrin and diamine-propylmethylamine resin in 2–50% solution |
| P 8 | Polyamide-epichlorohydrin resin manufactured from epichlorohydrin, adipic acid, caprolactame, diethylenetriamine and/or ethylenediamine, in 2–50% solution |
| P 9 | Polyamide-polyamine-epichlorohydrin resin manufactured from epichlorohydrin, dimethyl ester, adipic acid and diethylenetriamine, in 2–50% solution |
| P 10 | Polyamide-epichlorohydrin resin manufactured from epichlorohydrin, diethylenetriamine, adipic acid and ethyleneimine. |
| P 11 | Polyamide-epichlorohydrin resin manufactured from adipic acid, diethylenetriamine and a mixture of epichlorohydrin and dimethylamine in 2–50% solution. |
| P 12 | Cationic polyamide-polyamine resin manufactured from triethylenetriamine |
| P 13 | Products of condensation of aromatic sulfonic acids with formaldehyde |
| P 14 | Aluminium acetate |

TABLE II-continued

FLOCCULATING OR PRECIPITATING AGENTS

| Reference | Type of flocculating or precipitating agent |
|---|---|
| P 15 | Aluminium formate |
| P 16 | Mixture of acetate, sulfate and formate of aluminium |

Note:
When it is question of solutions, these are aqueous solutions.

TABLE III

| Composition (parts by dry weight) | Examples according to the invention 1 | 2 | 3 | 4 | 5 |
|---|---|---|---|---|---|
| Fibrous mixture including: | 97.5 | 97.5 | 97.5 | 97.5 | 107.5 |
| cellulose (a) | 67.5 | 67.5 | 67.5 | 67.5 | 67.5 |
| glass fibres (b) | 30 | 30 | 30 | 30 | 40 |
| addition of flocculating agent No. 1 (c) | 4 | 4 | 4 | 4 | 4 |
| addition of latex (d) | 100 | 100 | 100 | 100 | 100 |
| addition of flocculating agent No. 2 (e) (in vat) | 1.5 | 1.5 | 1.5 | 1.5 | 1.5 |
| sizing agent (f) | — | 1 | 1 | 1 | 1 |
| Anti-foam agent | NO | YES | YES | YES | YES |
| flocculating agent No. 3 (at the head) (g) | 0.87 | 0.84 | 0.85 | 0.84 | 0.88 |
| "Step 2" treatment | NO | NO | YES | YES | YES |
| size-press two faces | — | — | (h) | (i) | (i) |
| deposited dry (g/m$^2$) | — | — | 20–25 | 20–25 | 27–33 |

TABLE III-continued

| | | |
|---|---|---|
| | Notes | |
| (a) | cellulose fibres of conifers, with sodium hydroxide, bleached 25° SR | |
| (b) | glass fibres 4 mm, 11μ, "VITROFIL CSW" | |
| (c) | "Nadavin LT": polyamine/polyamide-epichlorohydrin | |
| (d) | latex: copolymer: vinyl acetate | 54–60% by weight |
| | ethylene | 10–16% by weight |
| | vinyl chloride | 27–33% by weight |
| (e)(g) | polyacrylamide of high molecular weight | |
| (f) | sizing agent C 25: dimer alkylketene of fatty acid | |
| (h) | Latex copolymer | 1500 parts (dry) |
| | vinyl chloride 70 to 90% | |
| | methyl acrylate 10 to 30% | |
| | (+ plasticizer 30 to 40%) | |
| | Dimer alkylketene of fatty acids | 50 parts (dry) |
| | Fungicidal product (derivative of Isothiazolin) | 10 parts (dry) |
| (i) | Acrylic latex comprising | 1500 parts (dry) |
| | ethyl acrylate 87 to 97% | |
| | acrylonitrile 1 to 8% | |
| | N. methylolacrylate 1 to 6% | |
| | acrylic acid 1 to 6% | |
| | Dimer alkylketene of fatty acids | 50 parts (dry) |
| | Fungicidal product (derivative of Isothiazolin) | 10 parts (dry) |

TABLE IV

| CHARACTERISTICS | Glass web 50 g/m2 impregnated with 473 g/m2 of Plastisol | Examples according to the invention 1 | 2 | 3 | 4 | 5 |
|---|---|---|---|---|---|---|
| Rough papers | | | | | | |
| Grammage (g/m2) | 523 | 218 | 212 | 238 | 246 | 253 |
| Thickness (microns) | 470 | 355 | 340 | 330 | 350 | 375 |
| Bulk | 0.9 | 1.6 | 1.6 | 1.4 | 1.4 | 1.5 |
| Tensile strength (kgf/15 mm) | | | | | | |
| Direction of operation | | | | | | |
| TE ambient | 7.4 | 18 | 18 | 21 | 21 | 23 |
| Hot 2' at 200° C. | 2.1 | 2.8 | 2.8 | 2.5 | 3.0 | 2.8 |
| COBB water 1' Web face | <10 | 150 | 11 | <10 | <10 | <10 |
| Felt face | <10 | 110 | 12 | <10 | <10 | <10 |
| Level of fluffing of the glass fibres | none | slight fluffing | slight fluffing | none none | none none | none none |
| PVC coated papers | | | | | | |
| on one face: | | | | | | |
| Pliability | good | good | good | good | good | good |
| (Curl)* (%) | <5 | <5 | <5 | <5 | <5 | <5 |
| on 2 faces: | | | | | | |
| Dimensional stability | <0.10 | <0.10 | <0.10 | <0.10 | <0.10 | <0.10 |
| Pliability | good | good | good | good | good | good |
| Resistance to delamination g/cm | >500 | 480–500 | 480–500 | >500 | >500 | >500 |

*Test acc. to French Patent n°82-12319

TABLE V

| Composition (parts by weight dry) | Examples according to the invention 6 | 7 | 8 |
|---|---|---|---|
| Fibrous mixture including: | 65 | 46.5 | 56.5 |
| cellulose (a) | 45 | 31.5 | 31.5 |
| glass fibres (b) | 20 | 15 | — |
| glass fibres (b) | — | — | 25 |
| addition of floccula-ting agent no. 1 (c) | 4 | 4 | 4 |
| addition of latex (d) | 100 | 100 | 100 |
| addition of floccula-agent no. 2 (e) (in vat) | 1 | 1 | 1 |
| sizing agent (f) | 1 | 1 | 1 |
| anti-foam agent | yes | yes | yes |
| addition of floccula-ting agent no. 3 (at the top) (g) | 0.5%* | 0.5%* | 0.5%* |

TABLE V-continued (a) (b) (c) (d) (e) (f) (g) cf Table III
(b') glass fibres length 3 mm (VETROTEX)
(*) % by weight dry with respect to the total dry composition

TABLE VI

| CHARACTERISTICS | Examples according to the invention 6 | 7 | 8 |
|---|---|---|---|
| Rough papers | | | |
| Grammage (g/m²) | 252 | 248 | 216 |
| Thickness (microns) | 318 | 311 | 300 |
| Bulk | 1.26 | 1.25 | 1.39 |
| Tensile strength (kgf/15 mm) | | | |
| Direction of operation | | | |
| TE ambient | 17 | 16.5 | 17 |
| Hot 2' at 200° C. | | | |
| PVC coated papers | | | |
| on one face | | | |
| Pliability: | good | good | good |
| on two faces | | | |
| Dimensional stability 24 h in water (elongation cross direction %) | 0.10 | 0.13 | 0.12 |
| Pliability | good | good | good |
| Resistance to delamination g/cm | >500 | >500 | >500 |

We claim:

1. A paper sheet characterized in that said sheet was prepared according to a paper making process from a composition comprising about 45–140 parts by dry weight of a fibrous mixture comprising about 30–90 parts by dry weight of cellulosic fibers and 15–50 parts by dry weight of mineral fibers per 100 parts by dry weight of a latex.

2. A paper sheet according to claim 1, wherein the mineral fibers are glass fibers.

3. A paper sheet according to claim 2 wherein the glass fibers have a length of between 3 and 12 mm and a diameter of about 5–15μ.

4. A paper sheet according to claim 2 wherein the glass fibers have a length of between 3 and 6 mm and a diameter of about 10–11μ.

5. A paper sheet according to claim 1 which contains a flocculant agent selected from the group consisting of:

aluminum sulfate, aluminium polychloride, sodium and calcium aluminate, mixture of polyacrylic acid and polyacrylamide in 5–30% (weight/volume) solution, polyethyleneimine in 2–50% (weights/volume) solution, copolymer of acrylamide and of β-methacrylyloxyethyltrimethyl ammonium methylsulfate, polyamine-epichlorhydrin and diamine-propylmethylamine resin in 2–50% solution, polyamide-epichlorhydrin resin manufactured from epichlorhydrin adipic acid, caprolactam, diethylenetriamine and/or ethylenediamine, in 2–50% solution, polyamide-polyamine-epichlorohydrin resin manufactured from epichlorhydrin, dimethyl ester, adipic acid and diethylenetriamine, in 2–50% solution, polyamide-epichlorhydrin resin manufactured from epichlorohydrin, diethylenetriamine, adipic acid and ethyleneimine, polyamide-epichlorhydrin resin manufactured from adipic acid, deithylenetriamine and a mixture of epichlorhydrin and dimethylamine in 2–50% solution, cationic polyamide-polyamine resin manufactured from triethylenetriamine, condensation products of aromatic sulfonic acids with formaldehyde, aluminium acetate, aluminium formate and a mixture of aluminium acetate, sulfate and formate.

6. A paper sheet according to claim 1 which is obtained by adding 1–10 parts of a first amount of a flocculating agent which is a polyamine/polyamide-epichlorhydrin to a fibrous mixture comprising 50 parts cellulosic fibers 25° SR, and 10 parts glass fibers 4 mm in length and 11μ in diameter followed by an addition of 100 parts of a latex of a copolymer of styrene-butadiene, an acrylic copolymer or a vinyl copolymer to the mixture, followed by an addition of 0.03 to 1 part of a second amount of a polyacrylamide flocculating agent followed by an addition of 0.04 to 0.8 part of a third amount of a polyacrylamide flocculating agent in a paper making machine, and wherein said second amount is added in the vat and the third amount is added at the top of said paper making machine and all parts added are by dry weight.

7. A paper sheet accourding to claim 6, wherein the amount of the polyamine/polyamide-epichlorhydrin added is 4 parts and the latex is a copolymer of vinyl chloride/ethylene/vinyl acetate or of a plasticised vinyl chloride/acrylate copolymer.

8. A paper sheet according to claim 2 wherein the latex is a copolymer of from 56–60% by weight of vinyl acetate, 10–16% by weight ethylene and 27–33% by weight of vinyl chloride.

9. A paper sheet according to claim 8, wherein 45 parts of cellulose fibers 25° SR, and 20 parts glass fibers 4 mm in length per 100 parts of latex are used to form the paper sheet.

10. A paper sheet according to claim 8, wherein 31.5 parts of cellulose fibers 25° SR, and 15 parts of glass fibers having a length of 3 mm per 100 parts of latex are used to form the paper sheet.

11. A paper sheet according to claim 8, wherein 31.5 parts of cellulose fibers 25° SR, and 25 parts of 3 mm length glass fibers per 100 parts of latex are used to form the paper sheet.

12. A paper sheet according to claim 1, wherein said composition additionally contains at least one flocculant of which a portion is added to said fibrous mixture after the addition of said latex and of conventional papermaking additives.

13. A paper sheet according to any of claims 1, 2, 3, 4, 6, 7, 8, 9, 10, 11 or 12 and which has been subjected to coating, impregnation or surfacing by means of a size-press, sprayer, blade spreader or roller spreader and optionally by heat or mechanical treatment.

14. A paper sheet comprising from 30–90 parts cellulose fibers, 15–50 parts glass fibers per 100 parts of at least one polymer selected from the group consisting of vinyl copolymers, styrene-butadiene copolymers, polymers and copolymers containing acrylic units, and mixtures thereof; said paper having a weight per unit surface in $g/m^2$ of from 212–253, thickness in μ of from 330 to 375 and a cold tensile strength of from 18–23 kgf/15 mm.

15. A paper sheet according to claim 14 coated on at least one surface with polyvinyl chloride.

* * * * *